US006983826B2

(12) United States Patent
Wake et al.

(10) Patent No.: US 6,983,826 B2
(45) Date of Patent: Jan. 10, 2006

(54) ELEVATOR DRIVE BELT

(75) Inventors: Atsuhito Wake, Yamatokohriyama (JP); Yoshihiro Konishi, Yamatokohriyama (JP); Kazuyuki Yuasa, Yamatokohriyama (JP); Atsuro Ueno, Yamatokohriyama (JP)

(73) Assignee: Nitta Corporation, Osaka (JP)

( * ) Notice: Subject to any disclaimer, the term of this patent is extended or adjusted under 35 U.S.C. 154(b) by 2 days.

(21) Appl. No.: 10/895,229

(22) Filed: Jul. 19, 2004

(65) Prior Publication Data

US 2004/0245051 A1 Dec. 9, 2004

Related U.S. Application Data

(63) Continuation of application No. PCT/JP03/00367, filed on Jan. 17, 2003.

(30) Foreign Application Priority Data

Jan. 18, 2002 (JP) ..... 2002-010263

(51) Int. Cl.
*B66B 11/04* (2006.01)

(52) U.S. Cl. ..... 187/252; 187/255; 187/250; 198/847

(58) Field of Classification Search ..... 198/846, 198/847; 187/250, 252, 255, 266, 251
See application file for complete search history.

(56) References Cited

U.S. PATENT DOCUMENTS

| | | | | |
|---|---|---|---|---|
| 4,004,467 | A * | 1/1977 | Kenney | 198/847 |
| 4,504,258 | A * | 3/1985 | Tanaka et al. | 198/847 |
| 5,595,284 | A * | 1/1997 | Takahashi et al. | 198/847 |
| 5,685,417 | A * | 11/1997 | Hasegawa et al. | 198/847 |

FOREIGN PATENT DOCUMENTS

| | | | |
|---|---|---|---|
| JP | 52-4814 | B2 | 2/1977 |
| JP | 2510732 | B2 | 6/1996 |
| JP | 2000-168930 | A | 6/2000 |
| WO | WO-02/064482 | A1 | 8/2002 |

* cited by examiner

*Primary Examiner*—James R. Bidwell
(74) *Attorney, Agent, or Firm*—Darby & Darby

(57) ABSTRACT

An elevator drive belt, while applying a friction force thereto, drives an elevator rope which links an elevator cage and a counterweight together. A rubber hardness of the belt ranges from about 50 to 90 degrees of JIS-A hardness so as to suppress creep slip due to a shearing strain while the elevator is in operation. Even if the elevator cage and the counterweight are reduced in weight and the friction force to be applied to the elevator rope decreases due to the weight reduction, a friction force onto the elevator rope from the elevator drive belt compensates and guarantees a drive force of the elevator.

41 Claims, 9 Drawing Sheets

ELEVATOR DRIVE BELT

CROSS-REFERENCE TO RELATED APPLICATION

This application is a Continuation of International Patent Application Ser. No. PCT/JP03/00367 filed Jan. 17, 2003, which was published in Japanese on Jul. 31, 2003 as WO 03/062116 A1, and claims priority under 35 U.S.C. §119 to Japanese Patent Application No. 2002-010263 filed on Jan. 18, 2002, which is incorporated herein by reference in its entirety.

BACKGROUND OF THE INVENTION

The present invention relates to an elevator drive belt.

Conventional elevators carry passengers or various kinds of goods, products or articles (hereinafter simply referred to as goods) in a cage in the vertical direction between floors of a building.

FIG. 8 illustrates one example of conventional elevators. This elevator has a cage 31 for carrying passengers or goods and a counterweight 32 which are connected with each other by a wire elevator rope 33. The rope 33 is wound around a sheave pulley 35 of a winding machine 34 (a motor) arranged at a top of the elevating path, and the elevator is operated like a well rope and bucket of a draw well.

There have been expectations of reducing the weight of the cage 31 and the counterweight 32, thereby reducing the cost of the elevator as a whole, and also reducing the burden on the building in which the elevator is installed.

However, weight reduction of the cage 31 and the counterweight 32 decreases a friction force between the sheave pulley 35 and the elevator rope 33. This causes a drive force from the winding machine to be insufficiently transmitted to the elevator rope 33, which ends up with a control failure and an unsafe drive of the cage 31 for carrying passengers or goods. It is not easy to achieve weight reduction of the elevator without losing a sufficient drive force.

It is, therefore, an object of the present invention to provide elevator-related products which favorably contribute to weight reduction of an elevator.

SUMMARY OF THE INVENTION

An elevator drive belt according to the present invention is used for an elevator with an elevator rope linking an elevator cage and a counterweight. The elevator drive belt drives the elevator rope while applying a friction force thereto. Hardness prescribed by JIS-A standard (hereinafter referred to as JIS-A hardness or simply hardness) of rubber materials of the belt ranges from about 50 to 90 degrees so as to suppress creep slip due to a shearing strain while the elevator is working.

Since the elevator drive belt generates a friction force against the elevator rope linking the elevator cage and the counterweight, even if the elevator cage and the counterweight are reduced in weight and a friction force to be applied to the elevator rope is reduced due to the weight reduction, the fiction generated from the elevator drive belt on the elevator rope compensates and guarantees the drive force of the elevator.

Since rubber hardness is set to suppress creep slip due to a shearing strain while the elevator is in operation, the safety during the operation can be secured. The term "in operation" here includes a state when the elevator is being driven, and a state when it is stopped.

Moreover, rubber hardness of the belt in the range between about 50 to 90 degrees of JIS-A hardness enables to secure a friction coefficient sufficient for a grip force on the elevator rope which is slippery due to oil oozing from inside (a lower rubber hardness is preferable), and enables to suppress creep slip due to a shearing strain at the time of a halt of the elevator (a higher rubber hardness is better). In other words, the conflicting important properties become compatible in the present invention.

Rubber materials of the belt include, for example, nitrile rubber, chloroprene rubber, polybutadiene rubber, EPDM, H-NBR, mirable urethane, and a combination of any two or more of them.

Into the rubber body of the belt, cords made of such as aramid fiber, nylon fiber, polyester fiber, glass fiber and steel fiber, or an endless core material woven with any one or more of the above fibers may be embedded.

Elastic materials of the rubber body may be reinforced with incorporation of one or more of short fibers selected from aramid fiber, nylon fiber, polyester fiber, glass fiber and cotton fiber.

The surface layer of the belt can contain short fibers.

Incorporation of short fibers in the surface layer which gives a friction force on the elevator rope may enhance abrasion resistance and grip force, and suppress a shearing strain. The short fiber materials may be one or more selected from aramid fiber, nylon fiber, polyester fiber, glass fiber and cotton fiber.

The elevator drive belt may have a multi-layered structure with a surface layer and an intermediate layer thereunder. The intermediate layer may be made of a rubber layer with hardness equal to or higher than that of the rubber material of the surface layer.

With the multi-layered structure of the rubber body of the belt, in which the intermediate layer is made of elastic rubber material having hardness no less than that of the surface layer, creep slip due to a shearing strain may be suppressed.

The rubber materials to be layered include, for example, nitrile rubber, chloroprene rubber, polybutadiene rubber, EPDM, H-NBR, mirable urethane and a combination of any two or more thereof.

One or more layers of woven fabric and/or knitted fabric may be embedded.

Reinforcing an inner layer by embedding woven or knitted fabric of one or more selected from aramid fiber, nylon fiber, polyester fiber, glass fiber and cotton fiber may further suppress a shearing strain.

The surface layer may be provided with a groove portion corresponding to the shape of the elevator rope and a narrow channel formed in and extending along with the groove portion.

As described above, providing a rounded or V-shaped groove portion corresponding to the shape and/or the number (plural number is possible) of the elevator rope(s) on the surface layer of the rubber material body which gives a friction force to the elevator rope increases the surface area in contact with the elevator rope, thereby enhancing the grip force. Providing a narrow channel extending longitudinally, laterally, or slant in and along with the groove portion on the surface layer of the rubber material body which applies a friction force on the elevator rope may enhance grip force by the so-called wedge effect. Furthermore, the narrow channel allows oil on the surface of the elevator rope to go away, and the grip force is maintained.

The surface layer may be covered with a woven and/or knitted fabric of one or more selected from aramid fiber, nylon fiber, polyester fiber, glass fiber and cotton fiber.

In addition to the above stated, the surface rubber layer may be provided with a woven or knitted fabric impregnated or coated with rubber and adhesive, so that abrasion resistance and a grip force may be improved.

DETAILED DESCRIPTION OF THE INVENTION

Figure 1:
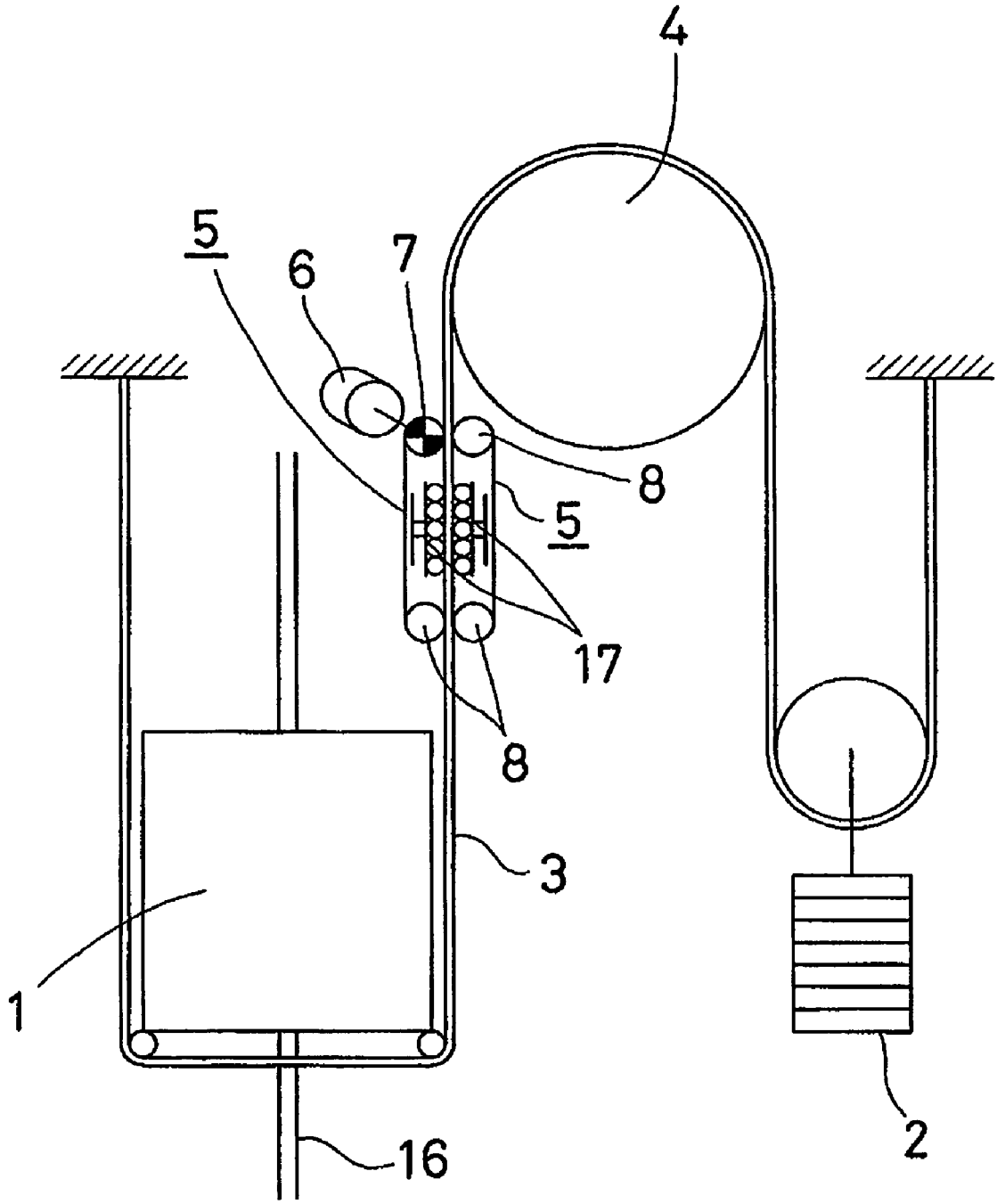
FIG. 1 is a view showing an embodiment of elevator drive belts according to the present invention.

As shown in FIGS. 1 to 7, an elevator has a cage 1 for carrying passengers or goods and a counterweight 2 which are connected with each other by means of a steel wire elevator rope 3. The rope 3 is wound around a sheave pulley 4 arranged at a top of the elevating path and the elevator is operated like a well rope and bucket in a draw well.

A pair of elevator drive belts 5 opposing with each other sandwiches the elevator rope 3 and provides a friction force thereto. To be more specific, one of the elevator drive belts 5 is wound around between a driving pulley 7 which is coaxial with an output shaft of a winding machine 6 (a motor) and a driven pulley 8, whereas the other one of the elevator drive belts 5 is wound around between other two separate driven pulleys 8. This pair of elevator drive belts 5 holds the elevator rope 3 therebetween with pressure and gives a friction force on the rope 3.

This pair of elevator drive belts 5 drives the elevator rope 3 linking the cage 1 and the counterweight 2 of the elevator by applying a friction force, and rubber hardness of the belts is set to restrain creep slip due to a shearing strain at the time of a halt of the elevator.

Figure 2:
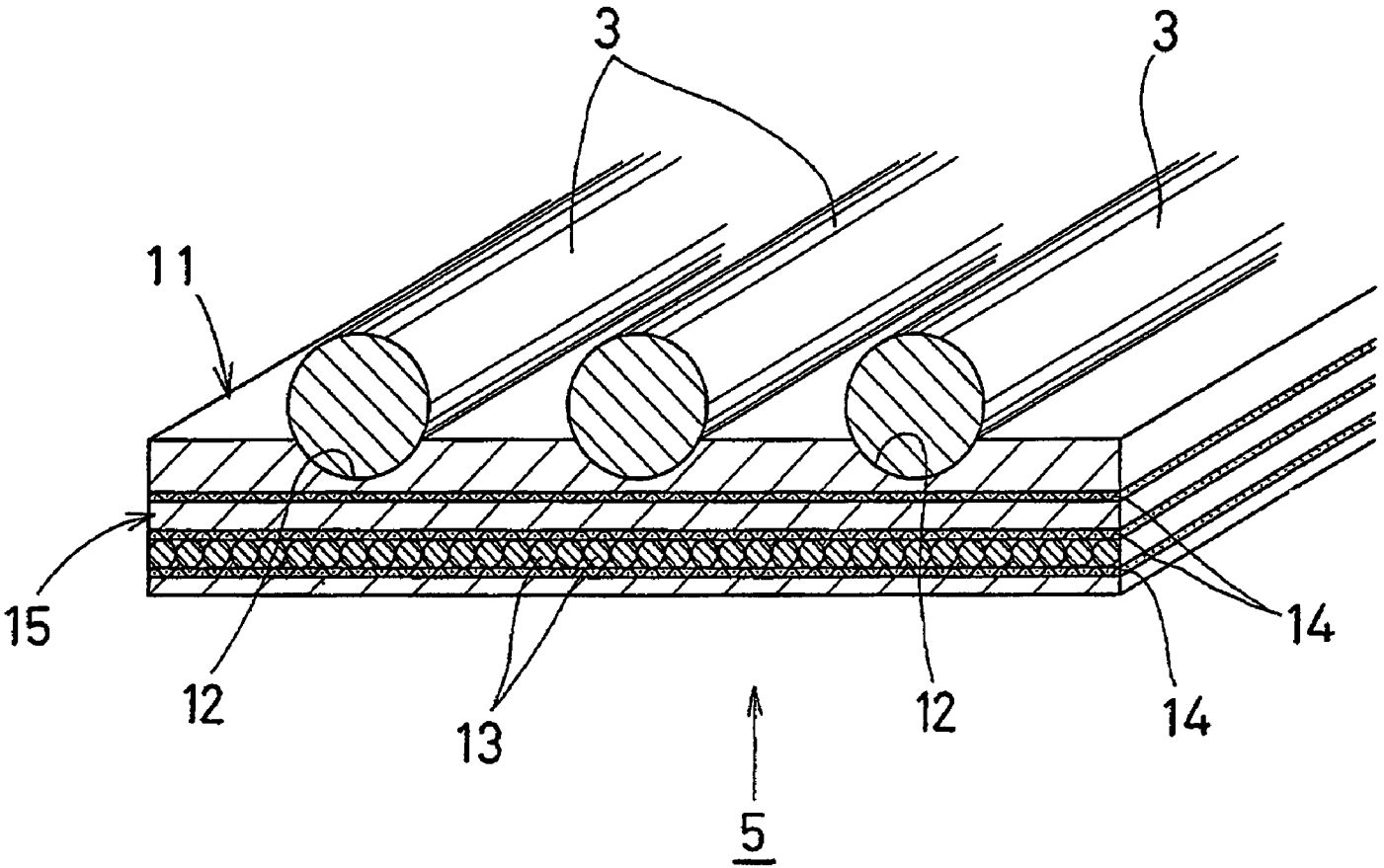
FIG. 2 is an enlarged perspective cross section of an essential part of the elevator drive belt shown in FIG. 1.

As shown in FIG. 2, a surface layer 11 of the belt 5 includes three rounded (semicircular-shape) groove portions 12 corresponding to the shape of the elevator ropes 3. Inside a rubber body of the belt 5 are buried endless seamless aramid cords 13 and three layers of polyamide woven fabric 14. The aramid cords 13 have been treated with solvent and form a core material of the belt 5. As a result, the belt 5 has high elasticity and high strength, and also durability such as abrasion resistance and crack resistance.

The rubber hardness is set to about 50 to 90 degrees of JIS-A hardness. To be more specific, the belt 5 has a multi-layered structure and the surface layer 11 is made of chloroprene rubber with a JIS-A hardness of 63 degrees, and an intermediate layer 15 under the surface layer 11 is also made of chloroprene rubber, but with a JIS-A hardness of 80 degrees.

The elevator drive belts of the present embodiment are used as follows.

The elevator drive belts 5 are mutually pressed against the elevator rope 3 by a pair of hydraulic devices 17, so that a friction force is generated between the elevator drive belts 5 and the elevator rope 3. Adjustment of the pressing force of the paired hydraulic devices 17 enables to control the friction force from the elevator drive belts 5 to the elevator rope 3.

Therefore, even if decrease in weight of the cage 1 and the counterweight 2 leads to decrease in friction on the elevator rope 3, the friction force applied from the elevator drive belts 5 to the elevator rope 3 securely compensates and guarantees the drive force of the elevator. Therefore, the rope 3 and the guide rail 16 supporting the elevator can be also advantageously reduced in weight. The foregoing structure contributes to reduction both in cost and weight of the elevator as a whole, furthermore, to reduction of burden on the building in which the elevator is installed. Since rubber hardness is set so as to suppress creep slip due to a shearing strain at the time the elevator is stopped, the stability of the elevator in a stationary state can be secured.

The rubber hardness of around 50 to 90 degrees of JIS-A hardness enables to secure a friction coefficient giving enough grip force on the elevator rope 3 which is slippery due to oil oozing from inside (a lower rubber hardness is preferable to counteract this effort), and to suppress creep slip due to a shearing strain at the time of a halt of the elevator (a higher rubber hardness is preferable to counteract this effort). Hence, these conflicting important properties become compatible in the belts.

The multi-layered structure of the rubber body of the belts, in which an elastic material of the intermediate layer 15 has a hardness equal to or higher than that of the rubber material of the surface layer 11, reliably suppresses creep slip due to a shearing strain. Reinforcement of the belt with a polyamide woven fabric buried in an inner layer of the rubber elastic material reliably suppresses a shearing strain.

The groove portion or portions 12 corresponding to the shape or the number, for example three of the elevator rope(s) 3 provided on the surface layer 11 of the rubber material body, which gives a friction force to the elevator rope 3, can increase a surface area in contact with the elevator rope 3 and, thereby increases a grip force.

Preferred embodiments according to the present invention will be specifically described below.

Figure 3:
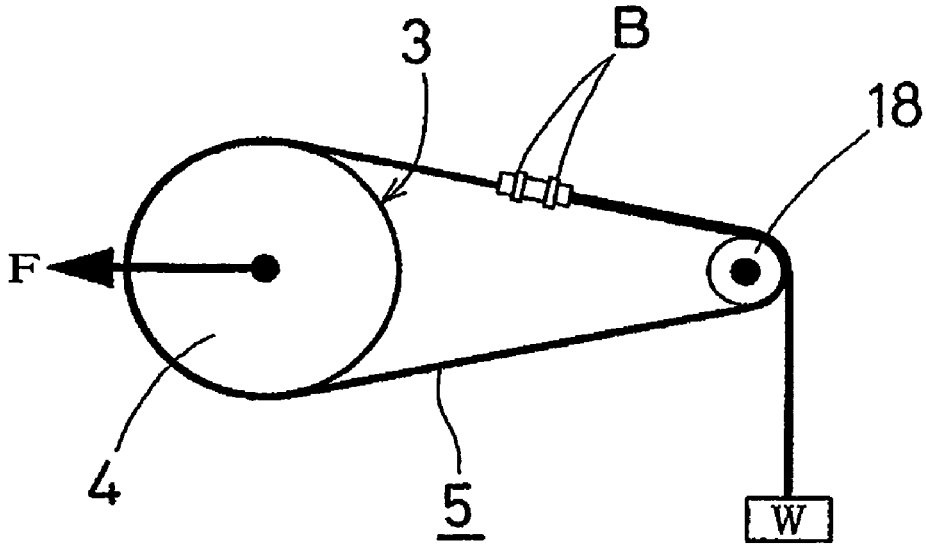
FIG. 3 is a view showing a method for testing elevator drive belts.

As shown in FIG. 3, an elevator drive belt 5 was wound around a 406 $\phi$ sheave pulley 4 and another pulley 18. The elevator rope 3 was stuck around the sheave pulley 4 in a non-rotatable manner. An unbalance weight W was applied to the elevator drive belt 5 with a bolt B.

The axis load F of the belt 5 was 300 kgf and the maximum load of the unbalance weight W that the belt 5 could bear was measured. To be more specific, the unbalance weight W was increased in load and the load at which an elevator drive belt 5 started to slip against the elevator rope 3 fixed around the sheave pulley 4 was recorded.

It is considered that the greater the load at the time the belt 5 starts to slip is, the smaller the strain in the rubber layer of the belt is, and slipping between the rubber of the surface layer 11 and the rope is small.

A test was conducted by using elevator drive belts 5, shown in FIG. 4 and provided with rounded groove portions 12, and by changing the rubber hardness of the surface layer 11 and that of the intermediate layer 15 as described below.

Embodiment 1

The surface layer 11 was made of chloroprene rubber with a hardness of 63 degrees, and the intermediate layer 15 under the surface layer 11 was also made of chloroprene rubber with a hardness of 63 degrees. As the result, the load was 104 kgf.

Embodiment 2

The surface layer 11 was made of chloroprene rubber with a hardness of 63 degrees, and the intermediate layer 15 under the surface layer 11 was also made of chloroprene rubber, but with a hardness of 80 degrees. As the result, the load was 120 kgf.

Embodiment 3

The surface layer 11 was made of chloroprene rubber with a hardness of 80 degrees, and the intermediate layer 15 under the surface layer 11 was also made of chloroprene rubber with a hardness of 80 degrees. As the result, the load was 98 kgf.

Embodiment 4

The surface layer 11 was made of chloroprene rubber with a hardness of 80 degrees, and the intermediate layer 15 under the surface layer 11 was also made of chloroprene rubber but with a hardness of 63 degrees. As the result, the load was 80 kgf.

Embodiment 5

The surface layer 11 was made of chloroprene rubber with a hardness of 72 degrees, and the intermediate layer 15 under the surface layer 11 was also made from chloroprene rubber with a hardness of 72 degrees. As the result, the load was 98 kgf.

Embodiment 6

The surface layer 11 was made of chloroprene rubber with a hardness of 68 degrees, and the intermediate layer 15 under the surface layer 11 was also made of chloroprene rubber with a hardness of 68 degrees. As the result, the load was 101 kgf.

Another test was conducted with the following varying shapes of the groove portions 12 into which the elevator ropes 3 are received. Similar to Embodiment 2, the surface layer 11 was made of chloroprene rubber with a hardness of 63 degrees, and the intermediate layer 15 under the surface layer 11 was also made of chloroprene rubber but with a hardness of 80 degrees.

Embodiment 2a

This embodiment is the same as Embodiment 2 stated above. As shown in FIG. 4, the belt 5 has the surface layer 11 of the rubber material with rounded groove portions 12 and no narrow channel 19 in the groove portions 12. As the result, the load was 120 kgf as mentioned above.

Embodiment 7

Figure 5:
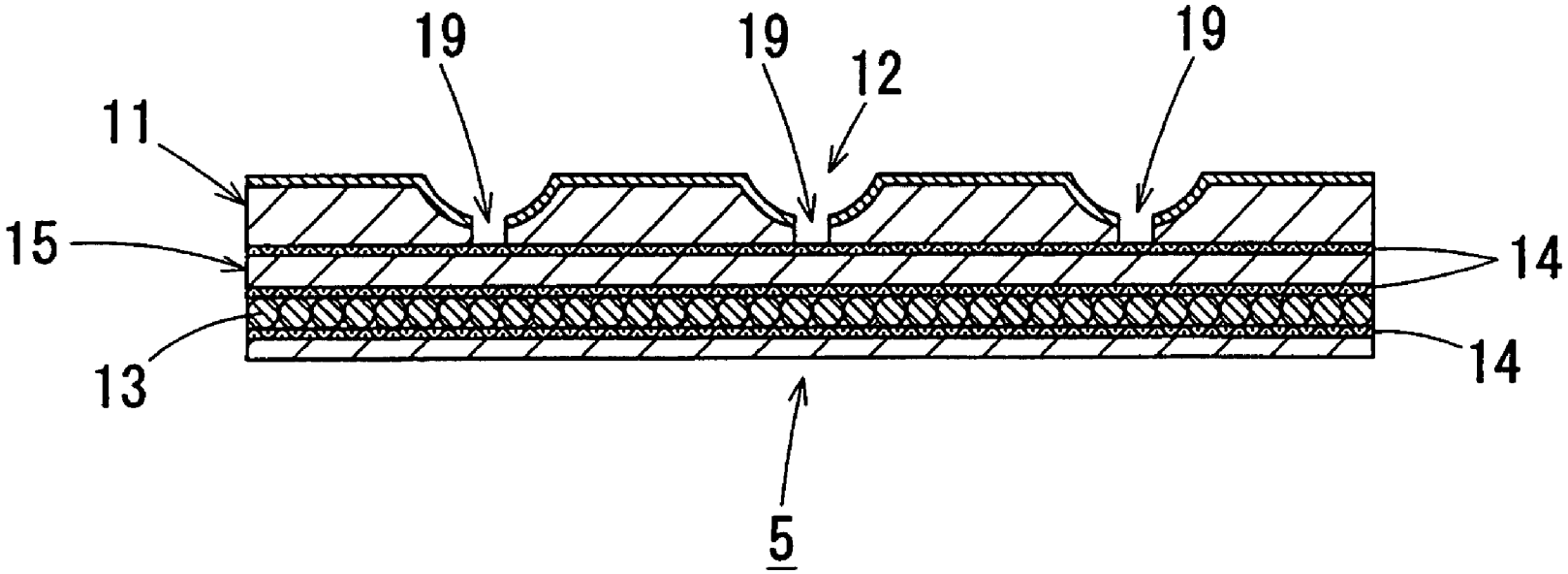
FIG. 5 is an enlarged cross section of an essential part of the elevator drive belt of Embodiment 7.
Figure 9:
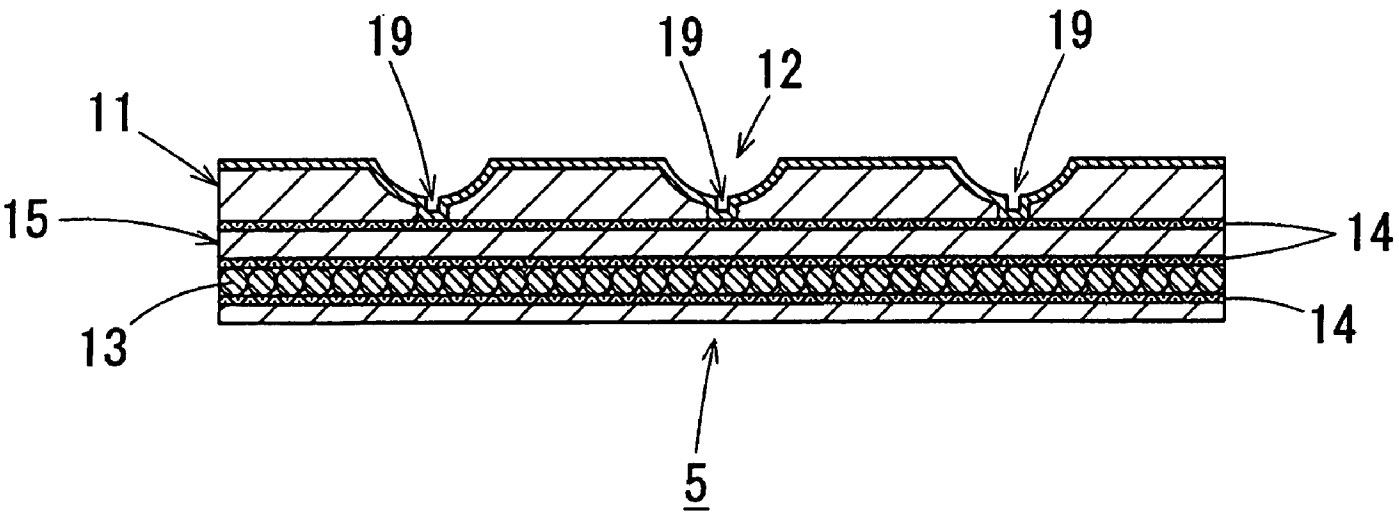
FIG. 9 is an enlarged cross section of an essential part of the elevator drive belt of embodiment 7.

As shown in FIG. 5 and FIG. 9, a single longitudinal narrow channel 19 is formed in and along with each of the groove portions 12 on the surface layer 11 of the rubber material.

The surface layer may be covered with a woven and/or knitted fabric 21 of one or more selected from aramid fiber, nylon fiber, polyester fiber, glass fiber and cotton fiber.

Embodiment 8

Figure 6:
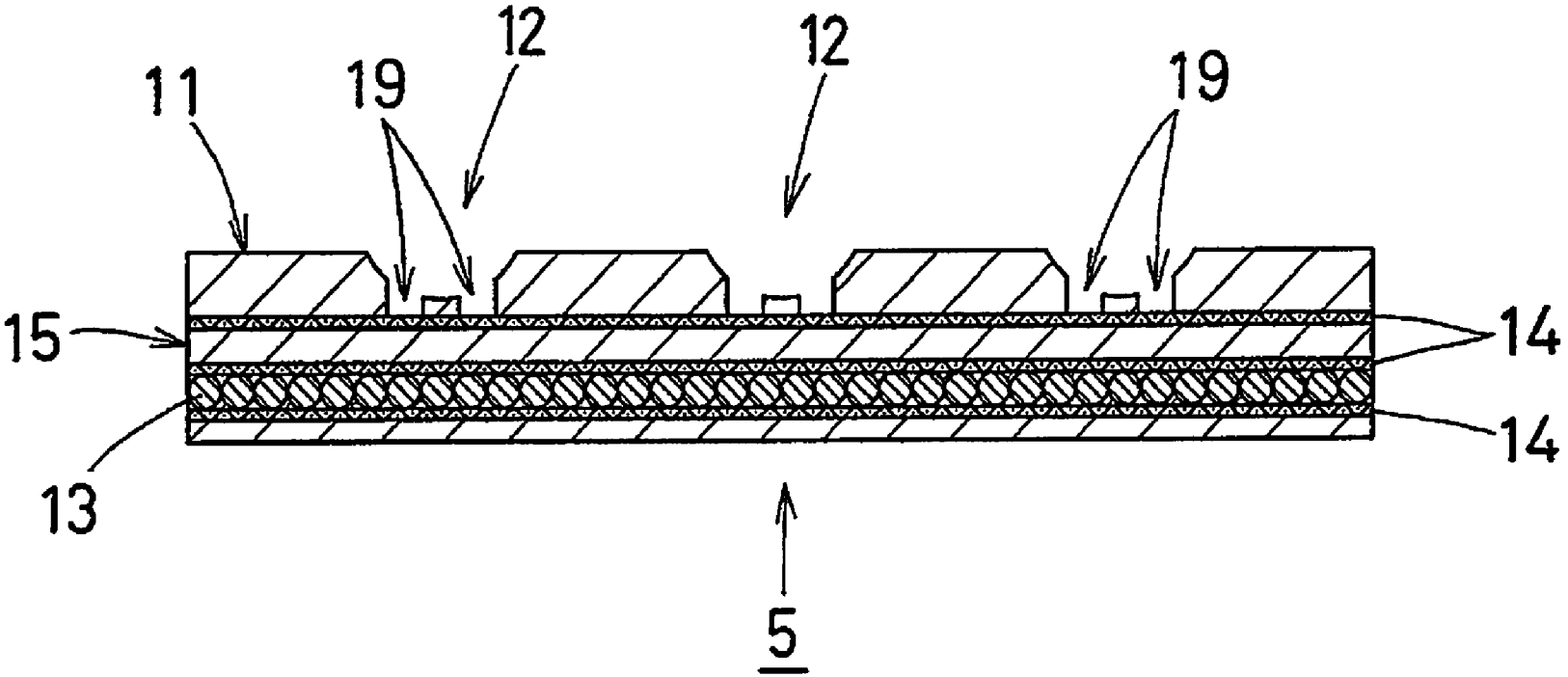
FIG. 6 is an enlarged cross section of an essential part of the elevator drive belts of Embodiment 8.

As shown in FIG. 6, two longitudinal narrow channels 19 are formed in and along with each of the groove portions 12 on the surface layer 11 of the rubber material. The load was 188 kgf.

Embodiment 9

Figure 7:
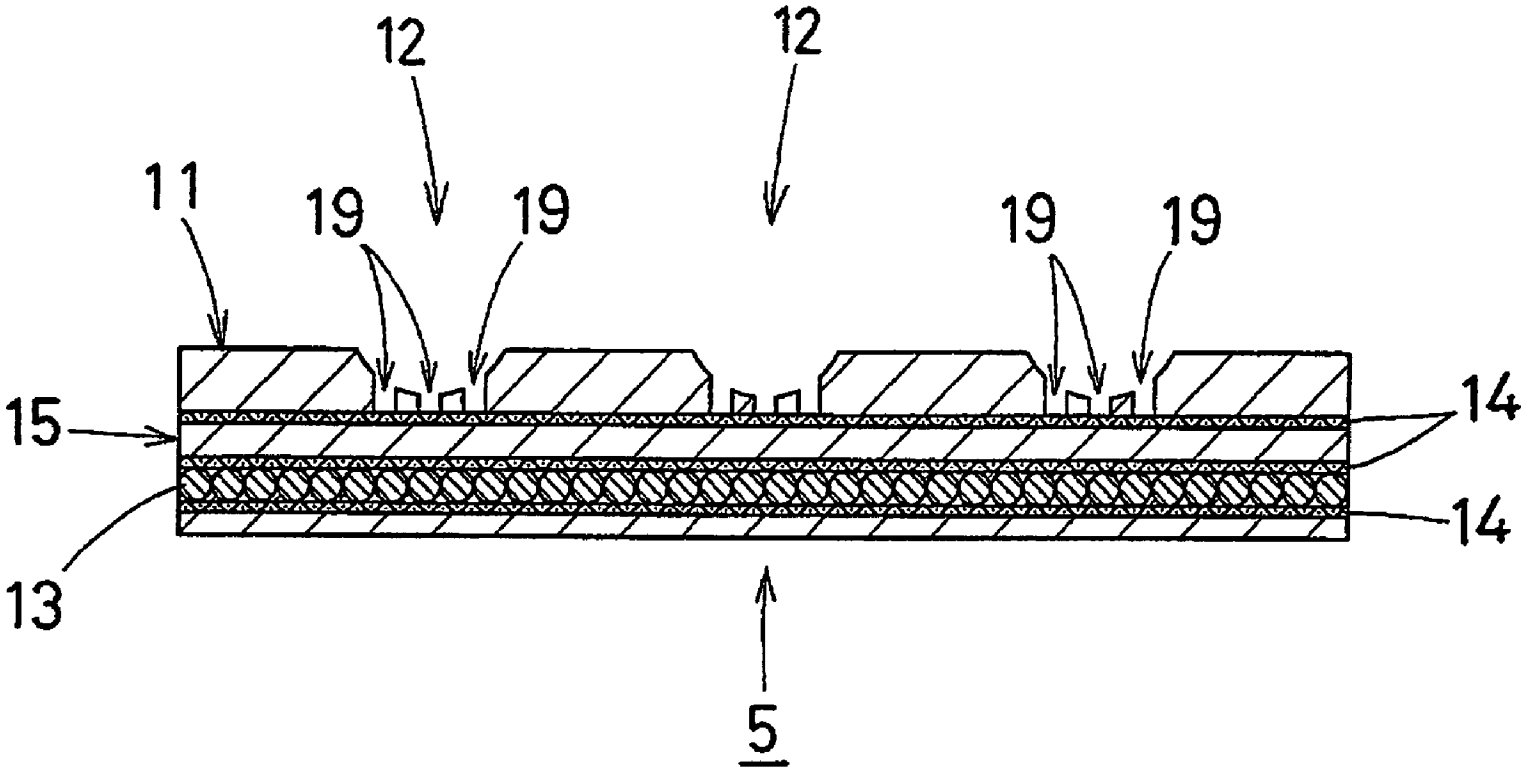
FIG. 7 is an enlarged cross section of an essential part of the elevator drive belt of Embodiment 9.
Figure 8:
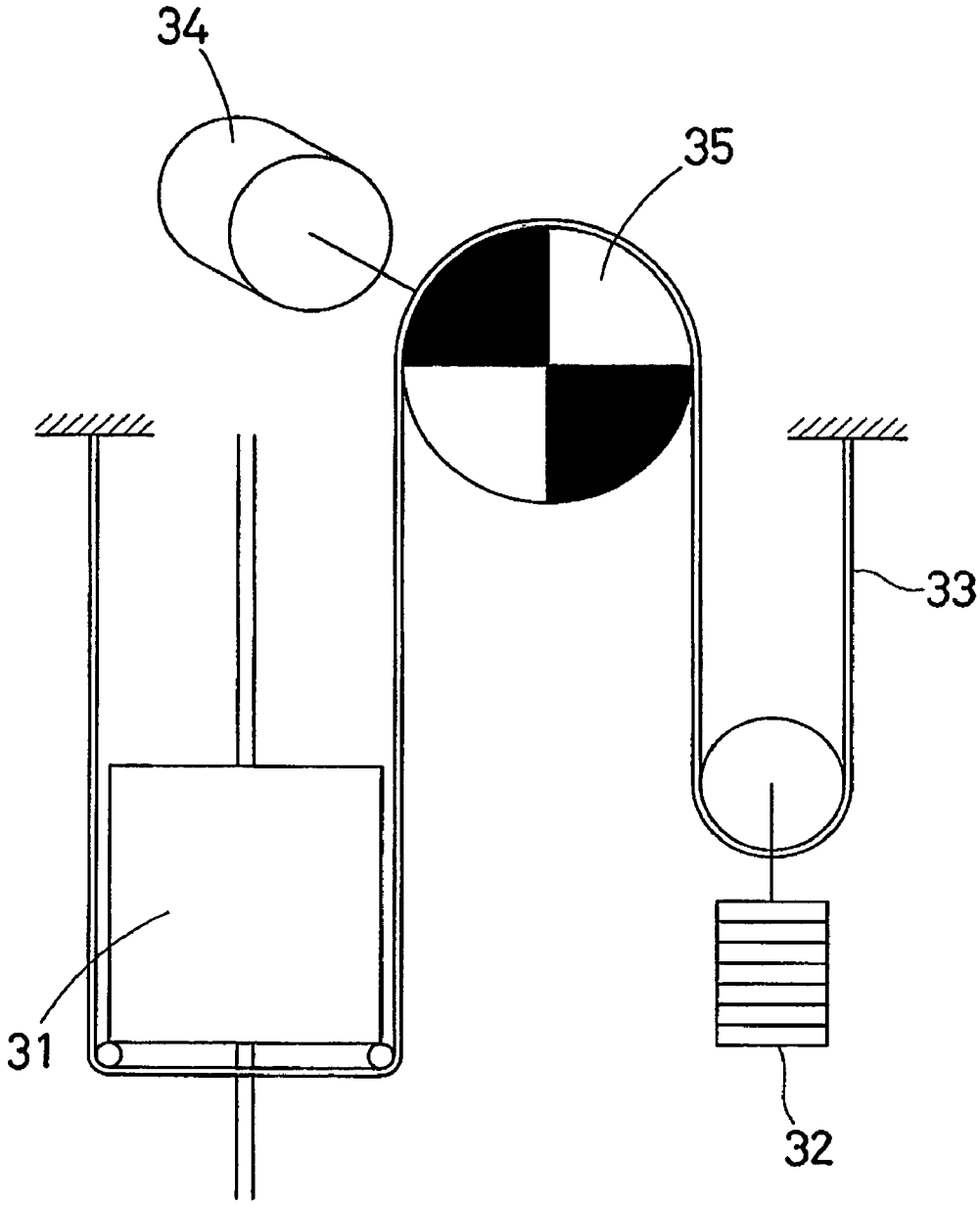
Prior Art Fig. 8
FIG. 8 is a view of a conventional elevator.

As shown in FIG. 7, three longitudinal narrow channels 19 are formed in and extending along with each of the groove portions 12 on the surface layer 11 of the rubber material. The load was 171 kgf.

As in Embodiments 7 to 9, providing one or more longitudinal narrow channels 19 enhances a grip force due to the so-called wedge effect. The narrow channels 19 favorably allow oil on the surface of the elevator ropes 3 to be drawn away.

Figure 4:
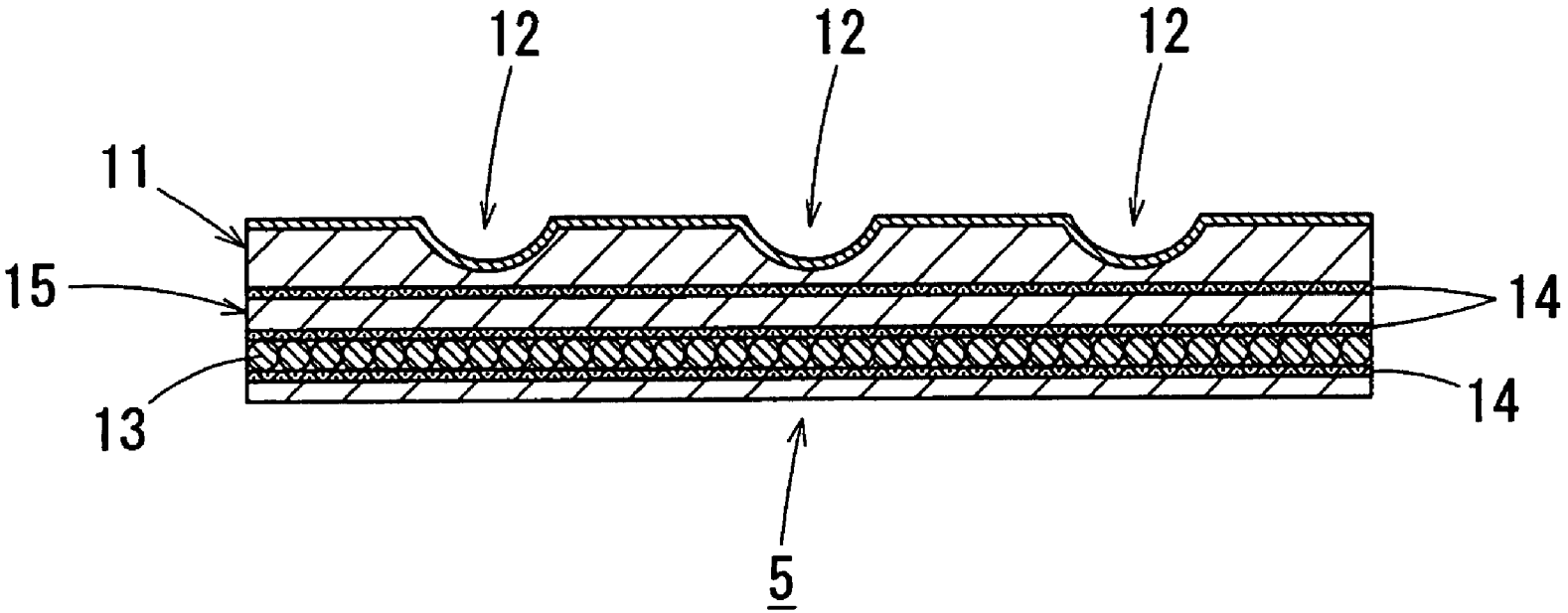
FIG. 4 is an enlarged cross section of an essential part of the elevator drive belt used in Embodiments 1 through 6.

Another test was conducted with the elevator drive belts 5 having rounded groove portions 12 as shown in FIG. 4, and by changing a rubber hardness of the surface layer 11 and that of the intermediate layer 15 as described below. And furthermore short fibers were incorporated into the surface layer 11.

Embodiment 10

The surface layer 11 was made of chloroprene rubber with a hardness of 70 degrees, and the intermediate layer 15 under the surface layer 11 was also made of chloroprene rubber but with a hardness of 80 degrees. As short fibers, cotton fibers were mixed into the surface layer 11. As the result, the load was 150 kgf.

Embodiment 11

The surface layer 11 was made of chloroprene rubber with a hardness of 80 degrees, and the intermediate layer 15 under the surface layer 11 was also made of chloroprene rubber with a hardness of 80 degrees. Aramid fibers were incorporated as short fibers into the surface layer 11. As the result, the load was 300 kgf.

As seen from Embodiments 10 and 11, short fibers incorporated in the surface layer 11 which gives a friction force to the elevator rope favorably enhances a grip force and abrasion resistance.

Constituted as stated above, the present invention can guarantee the drive force with the pressing force of the foregoing belts even if a cage and a counterweight are reduced in weight. Therefore, the present invention can provide elevator-related products which can contribute to effective weight reduction of the elevator.

What is claimed is:

1. An elevator drive belt for an elevator with an elevator rope linking an elevator cage and a counterweight together, comprising:

a drive belt applying a friction force to the elevator rope and driving the rope, and having a hardness of rubber material of the belt being about 50 to 90 degrees of JIS-A hardness so as to suppress creep slip due to a shearing strain while the elevator is in operation.

2. The elevator drive belt according to claim 1, wherein short fibers are incorporated into a surface layer of the belt.

3. The elevator drive belt according to claim 1, wherein the belt has a multi-layered structure including a surface layer and an intermediate layer thereunder, the intermediate layer is made of rubber layer of a hardness equal to and greater than that of the surface layer.

4. The elevator drive belt according to claim 2, wherein the belt has a multi-layered structure including the surface layer and an intermediate layer thereunder, the intermediate layer is made of rubber layer of a hardness equal to and greater than that of the surface layer.

5. The elevator drive belt according to claim 1, wherein a layer of at least one of woven and knitted fabrics is buried therein.

6. The elevator drive belt according to claim 2, wherein a layer of at least one of woven and knitted fabrics is buried therein.

7. The elevator drive belt according to claim 3, wherein a layer of at least one of woven and knitted fabrics is buried therein.

8. The elevator drive belt according to claim 4, wherein a layer of at least one of woven and knitted fabrics is buried therein.

9. The elevator drive belt according to claim 1, wherein a surface layer has a groove corresponding to a shape of the elevator rope and a narrow channel in the groove.

10. The elevator drive belt according to claim 2, wherein the surface layer has a groove corresponding to a shape of the elevator rope and a narrow channel in the groove.

11. The elevator drive belt according to claim 3, wherein the surface layer has a groove corresponding to a shape of the elevator rope and a narrow channel in the groove.

12. The elevator drive belt according to claim 4, wherein the surface layer has a groove corresponding to a shape of the elevator rope and a narrow channel in the groove.

13. The elevator drive belt according to claim 5, wherein the surface layer has a groove corresponding to a shape of the elevator rope and a narrow channel in the groove.

14. The elevator drive belt according to claim 6, wherein the surface layer has a groove corresponding to a shape of the elevator rope and a narrow channel in the groove.

15. The elevator drive belt according to claim 7, wherein the surface layer has a groove corresponding to a shape of the elevator rope and a narrow channel in the groove.

16. The elevator drive belt according to claim 8, wherein the surface layer has a groove corresponding to a shape of the elevator rope and a narrow channel in the groove.

17. The elevator drive belt according to claim 1, wherein a surface layer is covered with at least one of woven and knitted fabrics selected from a group consisting of aramid fiber, nylon fiber, polyester fiber, glass fiber and cotton fiber.

18. The elevator drive belt according to claim 2, wherein the surface layer is covered with at least one of woven and knitted fabrics selected from a group consisting of aramid fiber, nylon fiber, polyester fiber, glass fiber and cotton fiber.

19. The elevator drive belt according to claim 3, wherein the surface layer is covered with at least one of woven and knitted fabrics selected from a group consisting of aramid fiber, nylon fiber, polyester fiber, glass fiber and cotton fiber.

20. The elevator drive belt according to claim 4, wherein the surface layer is covered with at least one of woven and knitted fabrics selected from a group consisting of aramid fiber, nylon fiber, polyester fiber, glass fiber and cotton fiber.

21. The elevator drive belt according to claim 5, wherein the surface layer is covered with at least one of woven and knitted fabrics selected from a group consisting of aramid fiber, nylon fiber, polyester fiber, glass fiber and cotton fiber.

22. The elevator drive belt according to claim 6, wherein the surface layer is covered with at least one of woven and knitted fabrics selected from a group consisting of aramid fiber, nylon fiber, polyester fiber, glass fiber and cotton fiber.

23. The elevator drive belt according to claim 7, wherein the surface layer is covered with at least one of woven and knitted fabrics selected from a group consisting of aramid fiber, nylon fiber, polyester fiber, glass fiber and cotton fiber.

24. The elevator drive belt according to claim 8, wherein the surface layer is covered with at least one of woven and knitted fabrics selected from a group consisting of aramid fiber, nylon fiber, polyester fiber, glass fiber and cotton fiber.

25. The elevator drive belt according to claim 9, wherein the surface layer is covered with at least one of woven and knitted fabrics selected from a group consisting of aramid fiber, nylon fiber, polyester fiber, glass fiber and cotton fiber.

26. The elevator drive belt according to claim 10, wherein the surface layer is covered with at least one of woven and knitted fabrics selected from a group consisting of aramid fiber, nylon fiber, polyester fiber, glass fiber and cotton fiber.

27. The elevator drive belt according to claim 11, wherein the surface layer is covered with at least one of woven and knitted fabrics selected from a group consisting of aramid fiber, nylon fiber, polyester fiber, glass fiber and cotton fiber.

28. The elevator drive belt according to claim 12, wherein the surface layer is covered with at least one of woven and knitted fabrics selected from a group consisting of aramid fiber, nylon fiber, polyester fiber, glass fiber and cotton fiber.

29. The elevator drive belt according to claim 13, wherein the surface layer is covered with at least one of woven and knitted fabrics selected from a group consisting of aramid fiber, nylon fiber, polyester fiber, glass fiber and cotton fiber.

30. The elevator drive belt according to claim 14, wherein the surface layer is covered with at least one of woven and knitted fabrics selected from a group consisting of aramid fiber, nylon fiber, polyester fiber, glass fiber and cotton fiber.

31. The elevator drive belt according to claim 15, wherein the surface layer is covered with at least one of woven and knitted fabrics selected from a group consisting of aramid fiber, nylon fiber, polyester fiber, glass fiber and cotton fiber.

32. The elevator drive belt according to claim 16, wherein the surface layer is covered with at least one of woven and knitted fabrics selected from a group consisting of aramid fiber, nylon fiber, polyester fiber, glass fiber and cotton fiber.

33. The elevator drive belt according to claim 1, wherein a surface layer includes a groove corresponding to a shape of the elevator rope.

34. The elevator drive belt according to claim 33, wherein the surface layer is covered with at least one of woven and knitted fabrics selected from a group consisting of aramid fiber, nylon fiber, polyester fiber, glass fiber and cotton fiber.

35. An elevator drive belt for an elevator with an elevator rope linking an elevator cage and a counterweight together, comprising:

a first elevator drive belt; and a second elevator drive belt opposing the first elevator belt;

and wherein the first elevator drive belt and the second elevator drive belt hold the elevator rope therebetween, apply a friction force to the elevator rope and drive the elevator rope, and have a hardness of rubber material of about 50 to 90 degrees of JIS-A hardness to suppress creep slip due to a shearing strain while the elevator is in operation.

36. The elevator drive belt according to claim 35, wherein short fibers are incorporated into a surface layer of the belt.

37. The elevator belt according to claim 35, wherein the belt has a multi-layer structure including a surface layer and an intermediate layer thereunder, the intermediate layer is made of a rubber layer of a hardness equal to or greater than that of the surface layer.

38. The elevator drive belt according to claim 35, wherein a layer of at least one of woven and knitted fabrics is buried therein.

39. The elevator drive belt according to claim 35, wherein a surface layer has a groove corresponding to a shape of the elevator rope.

40. The elevator drive belt according to claim 35, wherein a surface layer has a groove corresponding to a shape of the elevator rope and a narrow channel in the groove.

41. The elevator drive belt according to claim 35, wherein the surface layer is covered with at least one of woven and knitted fabrics selected from a group consisting of aramid fiber, nylon fiber, polyester fiber, glass fiber and cotton fiber.

* * * * *